United States Patent [19]

Kietaibl

[11] Patent Number: 4,560,344

[45] Date of Patent: Dec. 24, 1985

[54] COMBINATION CIGARETTE LIGHTER AND BOTTLE OPENER

[75] Inventor: Josef Kietaibl, Langley, Canada

[73] Assignee: Four Time Enterprises Ltd., Abbotsford, Canada

[21] Appl. No.: 560,141

[22] Filed: Dec. 12, 1983

[51] Int. Cl.[4] ..... F23Q 2/16

[52] U.S. Cl. ..... 431/253; 7/151; 81/3.57

[58] Field of Search ..... 431/253; D27/36, 38; 7/151; 81/3.46 R, 3.46 A

[56] References Cited

U.S. PATENT DOCUMENTS 4,373,223 2/1983 Miller ..... 431/253

*Primary Examiner*—Carroll B. Dority, Jr.

*Attorney, Agent, or Firm*—Carver

[57] ABSTRACT

A combination of a cigarette lighter and a bottle opener which provides a compact apparatus having two components which are commonly used in similar social situations. The apparatus has a body to provide a fuel tank, and a cigarette lighter and bottle opener cooperate with the body at positions spaced sufficiently apart on the body to provide an elongated handle of sufficient length for grip and leverage to operate the bottle opener.

4 Claims, 11 Drawing Figures

COMBINATION CIGARETTE LIGHTER AND BOTTLE OPENER

BACKGROUND OF THE INVENTION

1. Field of the Invention

The invention provides a combination cigarette lighter and bottle opener apparatus in a compact unitary form, thus eliminating the need for two separate items.

2. Prior Art

Two accessories for use in many social situations include a bottle opener and a cigarette lighter. It is not unusual for both accessories to be required in every day social situations, and thus it might be convenient to combine the two accessories into one item, thus simplifying carrying them on one's person.

SUMMARY OF THE INVENTION

The present invention provides, in one item, a cigarette lighter and bottle opener, thus overcoming the necessity of carrying two separate items. Furthermore, the resulting combination is only slightly larger than a conventional cigarette lighter, or can be made to be about the same size. Furthermore, the invention provides a simple and economical way of adapting an existing disposable gas lighter to a combination lighter and bottle opener, or alternatively provides means of manufacturing an integral bottle opener and lighter combination.

A combination cigarette lighter and bottle opener according to the invention has an elongated body, a cigarette lighter assembly, a hollow sleeve, and a bottle opener. The body has a hollow interior to provide a fuel tank and opposite first and second ends spaced apart along a longitudinal axis, the first end having a closed end face. The cigarette lighter assembly cooperates with the second end of the body and has a fuel orifice which is connectable with the tank, and a manually actuated igniter means adjacent the orifice to ignite the fuel discharged from the orifice. The hollow sleeve has outer and inner ends and an interior to receive the body therein so that the cigarette lighter assembly extends from the outer end of the sleeve. A clearance is provided between the closed end face of the tank and an inner end of the sleeve. The bottle opener is provided at the inner end of the sleeve so as to be disposed remotely from the ligher assembly. The bottle opener has a bottle cap engaging means to engage a sealing cap of a bottle, and a fulcrum means to provide a fulcrum for levering the cap off the bottle. The bottle cap engaging means has a tough separate element which is retained in the clearance cap, the element being a generally V-shaped, wear-resisting strip having two end portions. One end portion has a rim engaging surface to engage a rim of the bottle cap. The other end portion bears against an end face of the tank and is located by the fulcrum means so as to resist forces imposed on the cap engaging means during removal of the cap from the bottle. The bottle opener and the cigarette lighter assembly are spaced apart along the body to provide an elongated handle of sufficient length to provide grip and leverage for the user to operate the bottle opener and lighter assembly with ease.

A detailed disclosure following, related to drawings, described preferred embodiments of the invention, which however is capable of expression in structure other than those particularly described and illustrated.

DETAILED DISCLOSURE

Figure 1:
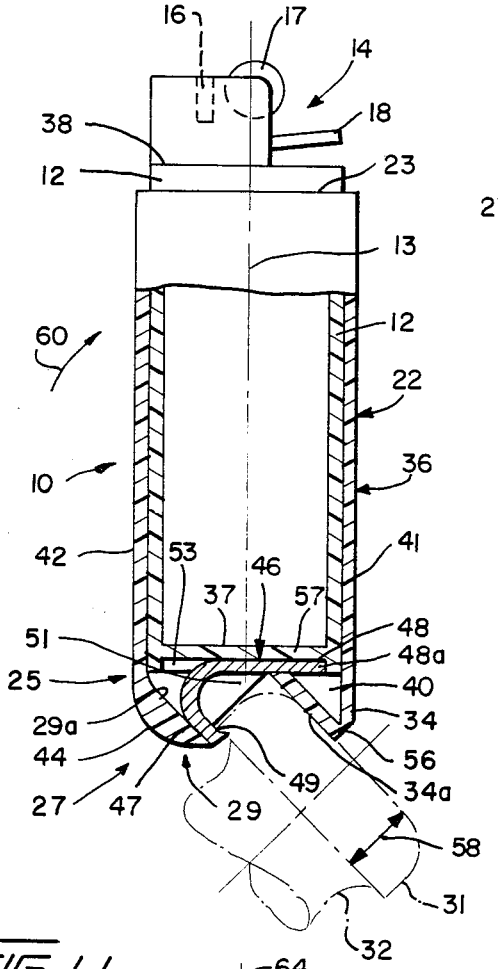
FIG. 1 is a simplified front elevation, partially in section, of a first embodiment of the invention.
Figure 3:
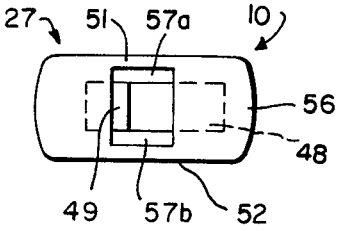
FIG. 3 is a bottom plan of the first embodiment of the invention.
Figure 2:
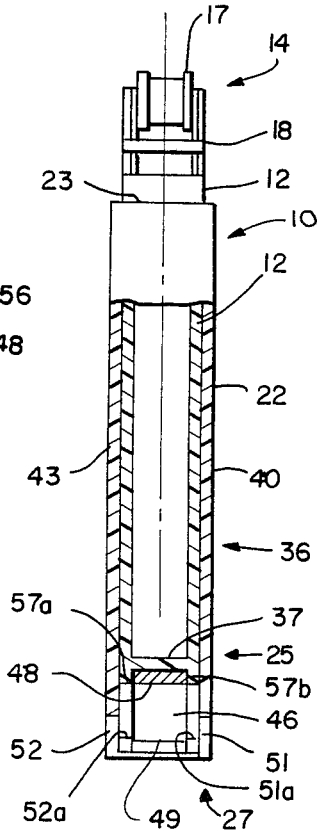
FIG. 2 is a simplified side elevation, partially in section, of the first embodiment.

FIGS. 1 through 3

A first embodiment of a combination cigarette lighter and bottle opener apparatus 10 according to the invention has a body 12 having a longitudinal axis 13. The apparatus includes a lighter assembly 14 which is integral with the body to form an integral unit for conventional operation, as in a common disposable cigarette lighter. The body 12 has a hollow interior to provide a fuel tank for the lighter assembly, the fuel commonly being pressurized butane or equivalent. The lighter assembly has a fuel orifice 16 which is connectable with the tank through a valve, not shown, and a manually actuated igniter means 17 is positioned adjacent the orifice to ignite the fuel discharged from the orifice. The lighter assembly can be one of several, easily available commercial types fueled by butane, in which case the orifice is controlled by the valve through a valve actuator 18. Alternatively, liquid lighter fuel can be used in the tank, in which case a wick is fitted in the orifice adjacent the igniter means. The lighter assembly itself is only a portion of the claimed combination, and many equivalents can be substituted for the embodiment illustrated.

The apparatus also includes hollow sleeve 22 which has an interior surface generally complementary to an outer portion of the body 12. The sleeve has an open outer end 23 to accept therein a portion of the body remote from the lighter assembly as shown. The sleeve also has an inner end 25 remote from the outer end and carrying a bottle opener 27. Before assembly, the body 12 and sleeve 22 are separate items, but after assembly, they are connected by adhesive, heat or shrinking means etc. so that the lighter assembly extends from the open end of the sleeve, and the bottle opener is disposed at the opposite end of the sleeve. The bottle opener includes a lever portion 29 for applying prying pressure to the rim of a bottle cap and a fulcrum portion 34 which engages the top surface of the bottle cap for levering the cap off the bottle. A typical bottle cap and bottle neck are shown in dotted lines and designated 31 and 32 respectively. Bottle cap 31 is received within a recess formed between lever portion 29 and fulcrum 34. The bottle opener and the lighter assembly are spaced apart along the body 12 to provide an elongated handle 36 of sufficient length to provide grip and leverage for the user to operate the bottle opener.

The opener 27 is disposed adjacent an end face 37 of fuel tank body 12 while the lighter assembly 14 is disposed at an opposite end face 38. Parallel side walls 41 and 42 of hollow sleeve 22 terminate at the inner end 25, the side wall 41 terminating at fulcrum portion 34 and the side wall 42 terminating at lever portion 29. Lever portion 29 carries some of the load incurred during removal of cap 31. Hollow sleeve 22 further includes parallel broad walls 40 and 43 which extend to form sides of fulcrum portion 34 and which also form thin spaced parallel webs 51 and 52 which become side wall extensions of lever portion 29.

Fulcrum portion 34 includes an angular wall **34*a* extending inwardly toward end face 37 of fuel tank body 12. Wall 34*a* includes an innermost edge extending transversely between and joining with spaced parallel webs 51 and 52. Thus, it may be seen that webs 51 and 52 forming side wall extensions of lever portion 29, join with fulcrum portion 34 to form a generally V-shaped configuration, with the innermost edge of wall 34*a* forming the apex of the V-shaped configuration. Furthermore, since webs 51 and 52** are spaced apart, an opening is formed therebetween.

Bottle opener 27 additionally includes a separate, generally V-shaped wear-resistant metal insert lever 46 including a first end portion 48 having an outermost end **48*a* and a second end portion 47 having an outer end 49 for engaging the rim of bottle cap 31. End portion 48 has a greater length than end portion 47. End portion 48 is retained in a gap or slot 53 formed in end face 37 of fuel tank body 12 and wedged between projecting shoulders 57*a* and 57*b*. End portion 47 extends into the opening formed between webs 51 and 52 with outer end 49 projecting slightly beyond the opening. Slot means are provided for receiving second end portion 47 of insert lever 46. The slot means include a pair of parallel ribs 51*a* and 52*a* extending on either side of second end portion 47 and formed in the corner regions where interior wall 29*a* joins with webs 51 and 52. Thus, end portion 47 lies adjacent to interior wall 29*a* between ribs 51*a* and 52*a*, with ribs 51*a* and 52*a* serving to position the sides of end portion 47**.

The innermost edge of wall **34*a* which forms the apex of the V-shaped configuration as previously described, is spaced inwardly from outermost end 48*a* of metal insert lever 46 and lies over end portion 48 thereby providing a locking means for insert 46, and together with the slot means preventing dislodgement of insert lever 46 from hollow sleeve 22**.

End portion 48 cooperates with end face 37 of fuel tank body 12 and with the apex of the V-shaped configuration to resist forces imposed on rim engaging outer end 49 and on lever portion 29 during removal of the cap from the bottle. A V-shaped groove (not shown) is formed in outer end 49 of insert 46 to aid in gripping the edge or rim of cap 31 in order to prevent accidental slippage. The lever portion 29 including webs 51 and 52 resist more of the forces imposed on the bottle opener during extraction of the bottle cap.

Insert lever 46 is provided in order to prevent excessive wear at the point of contact between the rim of the bottle cap and the bottle opener. Webs 51 and 52 straddle end portion 47 of insert 46 and serve to strengthen lever portion 29.

Fulcrum 34 includes a projection 56 which is spaced from rim engaging outer end 49 by an amount approximately equal to depth 58 of the bottle cap, and thus is basically similar to conventional bottle openers.

The sleeve can be molded from a suitably strong plastic compound, such as polycarbonate, A.B.S. etc., and the wear resisting strip can be asuitable metal, such as mild steel. In this embodiment, the strip 46 is fitted in the gap 53 as shown prior to final assembly of the sleeve 22 to the body 12 using adhesive etc. as previously described.

OPERATION

Operation of the lighter assembly 14 is conventional with the body 12 being gripped in the hand so that the thumb can actuate the igniter means 17 and the actuator 18. To operate the bottle opener, the grip on the body 12 is usually reversed and the rim engaging means 49 is fitted beneath the cap rim and the fulcrum means 34 engages an upper portion of the bottle cap. A twist is applied to the body in direction of an arrow 60, thus removing the cap from the bottle.

ALTERNATIVES AND EQUIVALENTS

The first embodiment of the invention 10 is shown with the bottle opener 27 incorporated into an end face of the sleeve at an opposite end of the body from the lighter assembly. This is preferred for convenience of operation and it requires only a slight increase in overall length over a common lighter. Alternative locations of the bottle opener are envisaged as described below.

Figure 4:
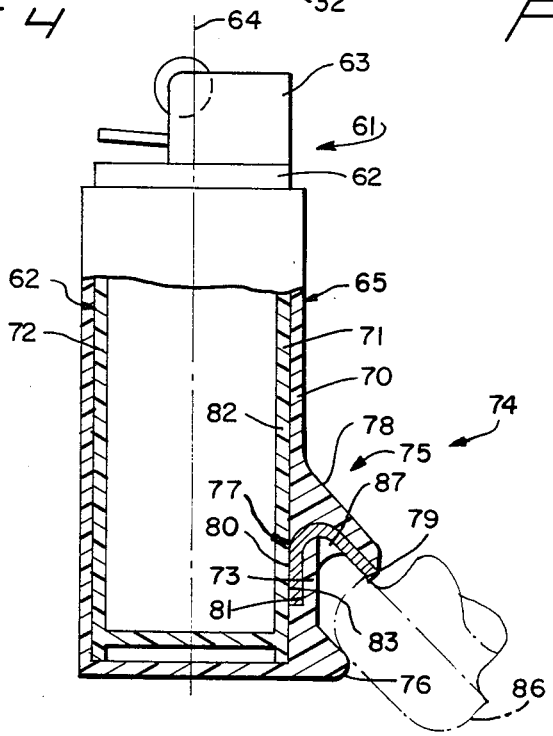
FIG. 4 is a simplified front elevation of a second embodiment of the invention, shown partially in section.
Figure 5:
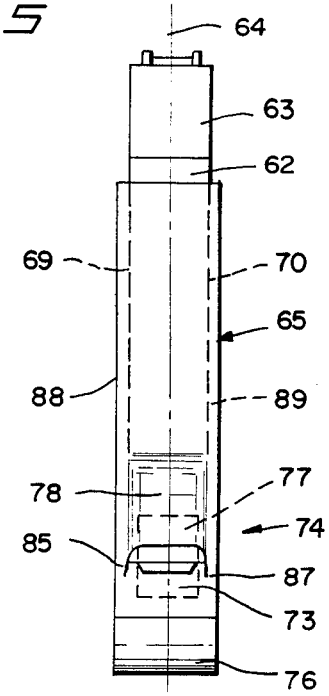
FIG. 5 is a simplified side elevation of the second embodiment, showing some hidden detail.

FIGS. 4 and 5

A second embodiment of the invention 61 has a similar body 62 and lighter assembly 63 which form an integral unit for self contained operation as previously described. The body 62 has a longitudinal axis 64 and the apparatus includes a hollow sleeve 65 which is somewhat similar to the sleeve 22. The body 62 has spaced generally parallel broad faces 69 and 70, and spaced parallel narrower side faces 71 and 72 to define a generally rectangular cross-section. A portion of the sleeve 65 adjacent the side face 71 is adapted to provide an alternative bottle opener 74 as follows. The bottle opener 74 has a bottle cap engaging means 75 and a fulcrum means 76 to provide a fulcrum for levering the cap off the bottle. Similarly to the previously described bottle opener, the bottle cap engaging means 75 has a generally V-shaped wear resisting strip 77 having one end portion 79 with a rim engaging surface, and an opposite end portion 80 which is generally flat and disposed parallel to the longitudinal axis 64 of the tank to bear against the side face 71 of the tank. The sleeve 65 has a recess 81 on an inner face 82 which is adjacent the side face 71 of the body. The body 62 has a surface portion 83 spaced from the recess 81 of the sleeve 65 to provide a clearance gap 84 therebetween and the end 80 of the wear resisting strip 77 is retained in the clearance gap between the sleeve and the body, in a manner similar to that previously described. Similarly to the bottle opener 27, the means 75 has a back up member 78 adjacent the portion 79. The sleeve has broad faces 88 and 89 which extend to form spaced parallel webs 85 and 87 to interconnect and strengthen the member 78. Also the fulcrum means 76 is spaced from the rim engaging surface 79 by an amount approximately equal to the depth of a bottle cap 86, shown in broken outline. The webs 85 and 87 extend from a root portion 73 disposed between the means 75 and 76.

It can be seen that the wear resisting strip 77 is disposed in the gap between the sleeve and the body, and thus can be fitted in the sleeve between the means 75, the portion 83 and the webs 85 and 87 during final assembly of the tank into the sleeve, prior to joining. The joining of the sleeve to the body is similar to the assembly of the FIG. 1 embodiment.

Figure 6:
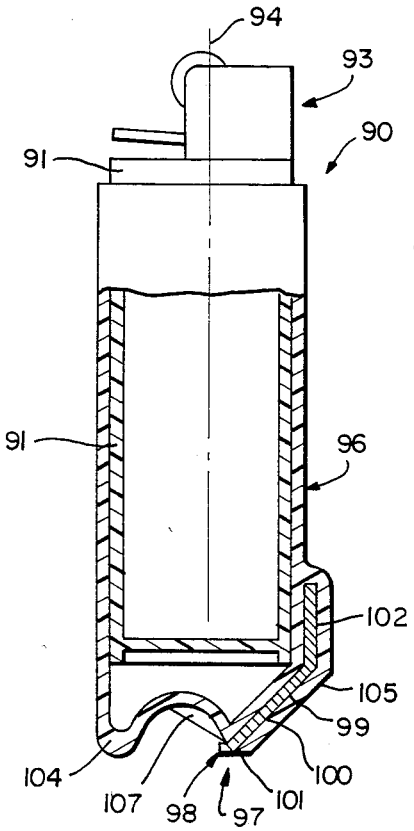
FIG. 6 is a side elevation of a third embodiment of the invention, shown partially in section.
Figure 7:
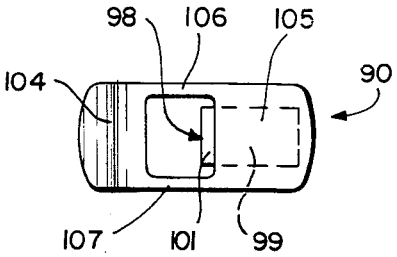
FIG. 7 is a bottom plan of the third embodiment of the invention, showing some hidden detail.

FIGS. 6 and 7

A third embodiment of the invention 90 differs from the previous embodiments by having an integrally moulded wear resistant strip in an alternative bottle opener. The embodiment 90 has a body 91 to serve as a fuel tank for a lighter assembly 93, which again can be an integral self-contained assembly having a longitudinal axis 94. An alternative hollow sleeve 96 has an interior generally complementary to an outer portion of the body, and functions generally similarly to the previously described sleeves with the exception that there is no requirement for a clearance space between the body and the sleeve to receive a wear resisting strip as in the embodiments previously described. Instead, the sleeve 96 has a bottle opener 97 which has a bottle cap engaging means 98 integrally moulded around an alternative, generally V-shaped wear resisting strip 99, which, as previously described can be a metal strip having two end portions. One end portion 100 of the strip has a rim engaging surface 101 to engage a rim of the bottle cap. An opposite end portion 102 of the strip is generally flat and disposed parallel to the longitudinal axis of the body. The portion 100 is supported by a back-up member 105 and spaced parallel webs 106 and 107 which extend on opposite sides of the portion 100. The bottle opener 97 has a fulcrum means 104 and functions similarly to the previously described embodiments.

Clearly, the tooling required for the embodiment of FIGS. 6 and 7 can be more complex than that previously described, as the integrally moulded strip 99 is fitted to form its complementary recess prior to injection of the plastic. One advantage is this lends itself to automated assembly with the body of the cigarette lighter because the strip 99 is already in place prior to final assembly.

Figure 8:
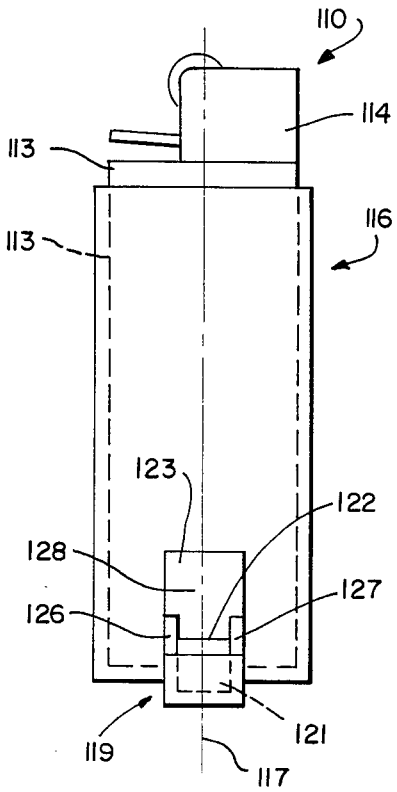
FIG. 8 is a simplified front elevation of the fourth embodiment of the invention, showing some hidden detail.
Figure 9:
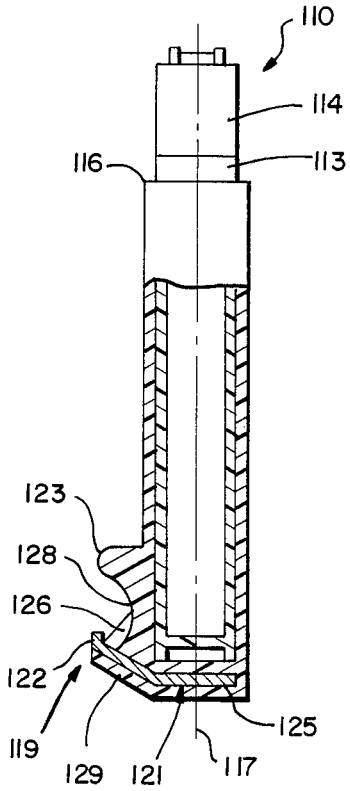
FIG. 9 is a simplified side elevation of the fourth embodiment of the invention, shown partially in section.

FIGS. 8 and 9

A fourth embodiment 110 of the invention has a body 113 having a longitudinal axis 117 and a lighter assembly 114 fitted within a complementary hollow sleeve 116 as previously described. The sleeve carries an alternative bottle opener adjacent an end of the sleeve remote from the lighter assembly 114. The bottle opener has a cap engaging means 119 which includes, as a separate element, a tough V-shaped wear resisting strip 121 having two ends. One end portion 122 of the strip carries a rim engaging surface to engage a cap of a bottle, and an opposite end portion 125 is generally flat and disposed normally to the longitudinal axis 117. The cap engaging means 119 is strenthened to backup member 129 and similar spaced parallel webs 126 and 127 which interconnect with a root portion 128 of the opener. The bottle opener also has a fulcrum means 123 and functions similarly to the previously described bottle openers.

Similarly to the bottle opener 97 of FIGS. 6 and 7, the wear resisting strip 121 is integrally moulded into the sleeve 116 and is supported by the adjacent back-up member 129 and the webs 126 and 127. Again, this requires a generally more complex tooling to permit insertion of the wear resisting strip prior to injection of the plastic to form the above.

Figure 10:
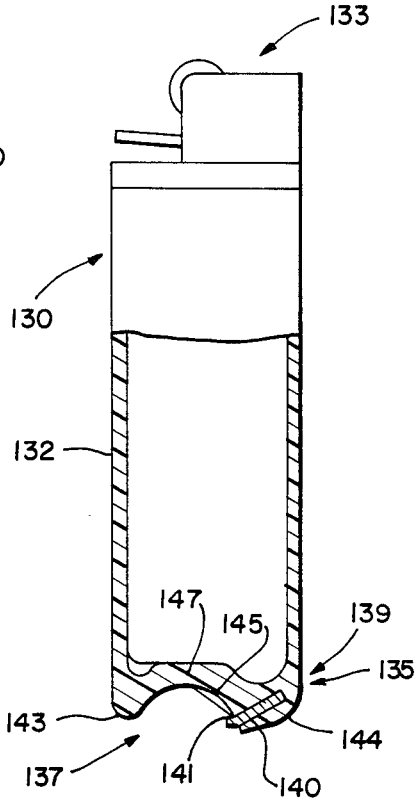
FIG. 10 is a simplified fragmented front elevation of a fifth embodiment of the invention, shown partially in section.
Figure 11:
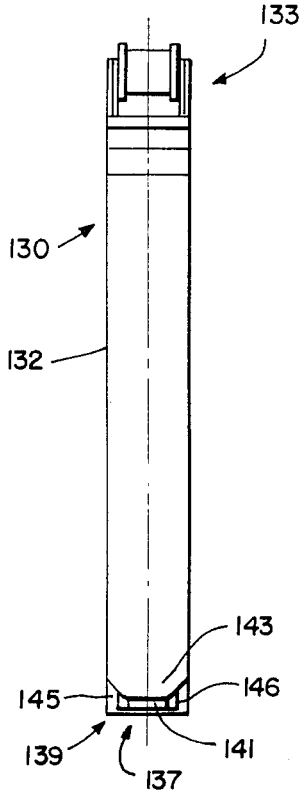
FIG. 11 is a simplified side elevation of the fifth embodiment of the invention.

FIGS. 10 and 11

A fifth embodiment 130 of the invention differs from the previously described embodiments by having a body 132 which is integrally moulded with a bottle opener 137, and also forms an integral unit together with a lighter assembly 133. Thus the hollow sleeve of the previously described four embodiments is eliminated, and the combination lighter body and bottle opener can be produced in one injection process.

Briefly, the body 132 has an end portion 135 remote from a lighter assembly 134, the end portion 135 having the alternative bottle opener 137. The bottle opener 137 has a cap engaging means 139 which includes a flat metal strip 140 which is surrounded by plastic material and has a rim engaging means 141 adapted to engage the rim of the bottle cap. The metal strip is sufficiently long to be supported by adjacent plastic, and does not require the additional length of the previous strips which were held against the body of the lighter assembly. The strip 140 is supported by a back-up member 144, and spaced parallel webs 145 and 146 on opposite sides of the strip 140 which extend to a root portion 147 of the body 132. Similarly to the previous described embodiments, the bottle opener 137 has a fulcrum means 143 and clearly functions in a manner similar to those previously described.

In summary, the five embodiments above show various locations of the bottle opener relative to the body or sleeve. The embodiments of FIGS. 1 through 3 shows the bottle opener 27 adjacent an end face of a sleeve or body and this resembles closely the location of the bottle opener 137 in FIGS. 10 and 11. The embodiment of FIGS. 4 and 5 shows the bottle opener on a side face of the sleeve of the lighter assembly, and clearly this location of the bottle opener could be incorporated into the bottle opener which is integrally moulded into the tank of the lighter assembly, as in the embodiment of FIGS. 10 and 11. The embodiment of FIGS. 8 and 9 show a bottle opener on the broad face of the sleeve, and clearly this location of bottle could also be incorporated into as assembly in which the bottle opener is integrally moulded into the body of the tank itself. In all cases, the bottle cap engaging means has a tough metal insert which is supported by an adjacent back-up member and a pair of spaced webs, the webs straddling the insert and extending between the back-up member and a root portion of the bottle opener. The root portion is disposed between the back-up member and the fulcrum member and the back-up member is on side of the insert remote from the fulcrum member.

I claim:

1. A combination cigarette lighter and bottle opener apparatus, comprising:

(a) an elongated hollow sleeve open at one end for receiving a disposable lighter assembly and bottle opening means at the other end thereof, (b) a disposable lighter assembly including an igniter portion comprising ignition means and a fuel tank portion connected to said igniter portion, (c) said fuel tank portion including a top wall, side walls and a bottom wall, said bottom wall having lever insert position retaining means, (d) said fuel tank portion being positioned within said hollow sleeve with said igniter portion extending through said open end, (e) said bottle opening means including a recess for receiving a bottle cap, said recess being formed between a lever portion for applying prying pressure to the rim of the bottle cap and a fulcrum portion for engaging the top of the bottle cap, said fulcrum portion and said lever portion being angularly disposed relative to each other and forming a V-shaped configuration in said other end of said hollow sleeve, (f) an opening formed in said lever portion, (g) said bottle opening means further including a separate, generally V-shaped metal lever insert having a first end portion including an outermost end, said first end portion being retained by said lever insert position retaining means, and said metal lever insert having a second end portion including an outer end extending into, through and projecting slightly beyond said opening formed in said lever portion to form a rim engaging edge for the bottle cap, (h) said other end of said hollow sleeve having on the inside thereof, adjacent said lever portion, slot means for receiving said metal lever insert second end portion, and (i) the apex of said V-shaped configuration of said other end of said hollow sleeve being spaced inwardly from said outermost end of said first end portion of said metal lever insert, lying over said first end portion, and forming a locking means for said metal lever insert, whereby said apex of said V-shaped configuration and said slot means for receiving said metal lever insert second end portion prevent dislodgement of said metal lever insert from said hollow sleeve.

2. A combination cigarette lighter and bottle opener apparatus as in claim 1, wherein:

(a) said lever insert position retaining means comprising a slot formed in said bottom wall of said fuel tank portion for receiving said first end portion of said metal lever insert, and (b) said slot being bounded by shoulders which engage and retain said first end portion of said metal lever insert.

3. A combination cigarette lighter and bottle opener apparatus as in claim 1, wherein:

(a) said first end portion of said metal lever insert being of greater length than said second end portion of said metal lever insert.

4. A combination cigarette lighter and bottle opener apparatus as in claim 1, wherein:

(a) said slot means include a pair of parallel ribs extending on either side of said second end portion of said metal lever insert.

* * * * *